US009869157B2

(12) United States Patent
Sevadjian et al.

(10) Patent No.: US 9,869,157 B2
(45) Date of Patent: Jan. 16, 2018

(54) REVERSE CIRCULATION CEMENTING SYSTEM FOR CEMENTING A LINER

(71) Applicant: Halliburton Energy Services, Inc., Houston, TX (US)

(72) Inventors: Emile Sevadjian, Carrollton, TX (US); Gary Kohn, Carrollton, TX (US); Arthur Stautzenberger, Denton, TX (US); Richard Noffke, Frisco, TX (US); Grant Hartman, Lawton, OK (US); Stephen Maddux, Carrollton, TX (US); Odee Daigle, Sachse, TX (US); Ryan Humphrey, Dallas, TX (US); David Matus, Prosper, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 32 days.

(21) Appl. No.: 14/906,403

(22) PCT Filed: Oct. 9, 2013

(86) PCT No.: PCT/US2013/064018
§ 371 (c)(1),
(2) Date: Jan. 20, 2016

(87) PCT Pub. No.: WO2015/038171
PCT Pub. Date: Mar. 19, 2015

(65) Prior Publication Data

US 2016/0160603 A1 Jun. 9, 2016

Related U.S. Application Data

(63) Continuation of application No. PCT/US2013/059324, filed on Sep. 11, 2013.

(51) Int. Cl.
*E21B 33/14* (2006.01)
*E21B 43/10* (2006.01)
(Continued)

(52) U.S. Cl.
CPC ..... *E21B 33/14* (2013.01); *E21B 33/12* (2013.01); *E21B 33/134* (2013.01); *E21B 34/06* (2013.01);
(Continued)

(58) Field of Classification Search
CPC ..... E21B 33/14; E21B 43/10; E21B 43/103; E21B 2034/007; E21B 34/14; E21B 21/103
See application file for complete search history.

(56) References Cited

U.S. PATENT DOCUMENTS 3,223,159 A 12/1965 Brown
4,223,747 A 9/1980 Marais
(Continued)

FOREIGN PATENT DOCUMENTS

WO 2012-065126 A2 5/2012
WO WO 2012065126 A2 5/2012

OTHER PUBLICATIONS

Examination Report No. 1 issued by IP Australia regarding Australian Patent Application No. 2013400137 dated Dec. 5, 2016, 7 pages.

(Continued)

*Primary Examiner* — Catherine Loikith
(74) *Attorney, Agent, or Firm* — Haynes and Boone, LLP

(57) ABSTRACT

Reverse circulation cementing of a liner in a wellbore extending through a subterranean formation is presented. A running tool with expansion cone, release assembly, annular isolation device, and reverse circulation assembly is run-in with a liner. The annular isolation device is set against the casing. A valve, such as a dropped-ball operated sliding sleeve valve, opens reverse circulation ports for the cementing operation. The liner annulus is cemented using reverse circulation. The expandable liner hanger is expanded into
(Continued)

engagement with the casing. Conventional circulation is restored. The running tool is released and pulled from the hole.

24 Claims, 12 Drawing Sheets

(51) Int. Cl.

| | |
|---|---|
| ***E21B 34/14*** | (2006.01) |
| ***E21B 33/12*** | (2006.01) |
| ***E21B 33/134*** | (2006.01) |
| ***E21B 34/06*** | (2006.01) |
| ***E21B 34/12*** | (2006.01) |
| *E21B 34/00* | (2006.01) |

(52) U.S. Cl.
CPC ..... *E21B 34/12* (2013.01); *E21B 34/14* (2013.01); *E21B 43/10* (2013.01); *E21B 43/103* (2013.01); *E21B 43/106* (2013.01); *E21B 2034/007* (2013.01)

(56) References Cited

U.S. PATENT DOCUMENTS

| | | | | |
|---|---|---|---|---|
| 4,854,386 | A | 8/1989 | Baker et al. | |
| 7,108,080 | B2 * | 9/2006 | Tessari ..... | E21B 7/20 175/21 |
| 2004/0099423 | A1 | 5/2004 | Badrak et al. | |
| 2004/0256157 | A1 | 12/2004 | Tessari et al. | |
| 2009/0020285 | A1 | 1/2009 | Chase et al. | |

OTHER PUBLICATIONS

International Search Report and Written Opinion issued by the Korean Intellectual Property Office regarding International Application No. PCT/US2013/064018, dated May 28, 2014, 11 pages.

* cited by examiner

REVERSE CIRCULATION CEMENTING SYSTEM FOR CEMENTING A LINER

CROSS-REFERENCE TO RELATED APPLICATIONS

This application is a U.S. National Stage Entry of International Application No. PCT/US2013/064018 filed Oct. 9, 2013, which claims priority to International Application No. PCT/US2013/059324 filed Sep. 11, 2013, the entire disclosures of which are hereby incorporated herein by reference.

FIELD OF INVENTION

Generally, methods and apparatus are presented for reverse circulation cementing operations in a subterranean well. More specifically, reverse circulation cementing of a liner string below a liner hanger is presented.

BACKGROUND OF INVENTION

In order to produce hydrocarbons, a wellbore is drilled through a hydrocarbon-bearing zone in a reservoir. In a cased hole wellbore (as opposed to an open hole wellbore) a tubular casing is positioned and cemented into place in the wellbore, thereby providing a tubular between the subterranean formation and the interior of the cased wellbore. Commonly, a casing is cemented in the upper portion of a wellbore while the lower section remains open hole.

It is typical to "hang" a liner or liner string onto the casing such that the liner supports an extended string of tubular below it. Conventional liner hangers can be used to hang a liner string from a previously set casing. Conventional liner hangers are known in the art and typically have gripping and sealing assemblies which are radially expanded into engagement with the casing. The radial expansion is typically done by mechanical or hydraulic forces, often through manipulation of the tool string or by increasing tubing pressure. Various arrangements of gripping and sealing assemblies can be used.

Expandable liner hangers are used to secure the liner within a previously set casing or liner string. Expandable liner hangers are set by expanding the liner hanger radially outward into gripping and sealing contact with the casing or liner string. For example, expandable liner hangers can be expanded by use of hydraulic pressure to drive an expanding cone, wedge, or "pig," through the liner hanger. Other methods can be used, such as mechanical swaging, explosive expansion, memory metal expansion, swellable material expansion, electromagnetic force-driven expansion, etc.

It is also common to cement around a liner string after it is positioned in the wellbore. Running cement into the annulus around the liner is performed using conventional circulation methods. The disclosure addresses methods and apparatus for reverse circulation cementing of a liner.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIGS. 1A and 1B also indicate a first dropped ball valve to divert tubing pressure to actuate an annular isolation device;

Figure 1A:
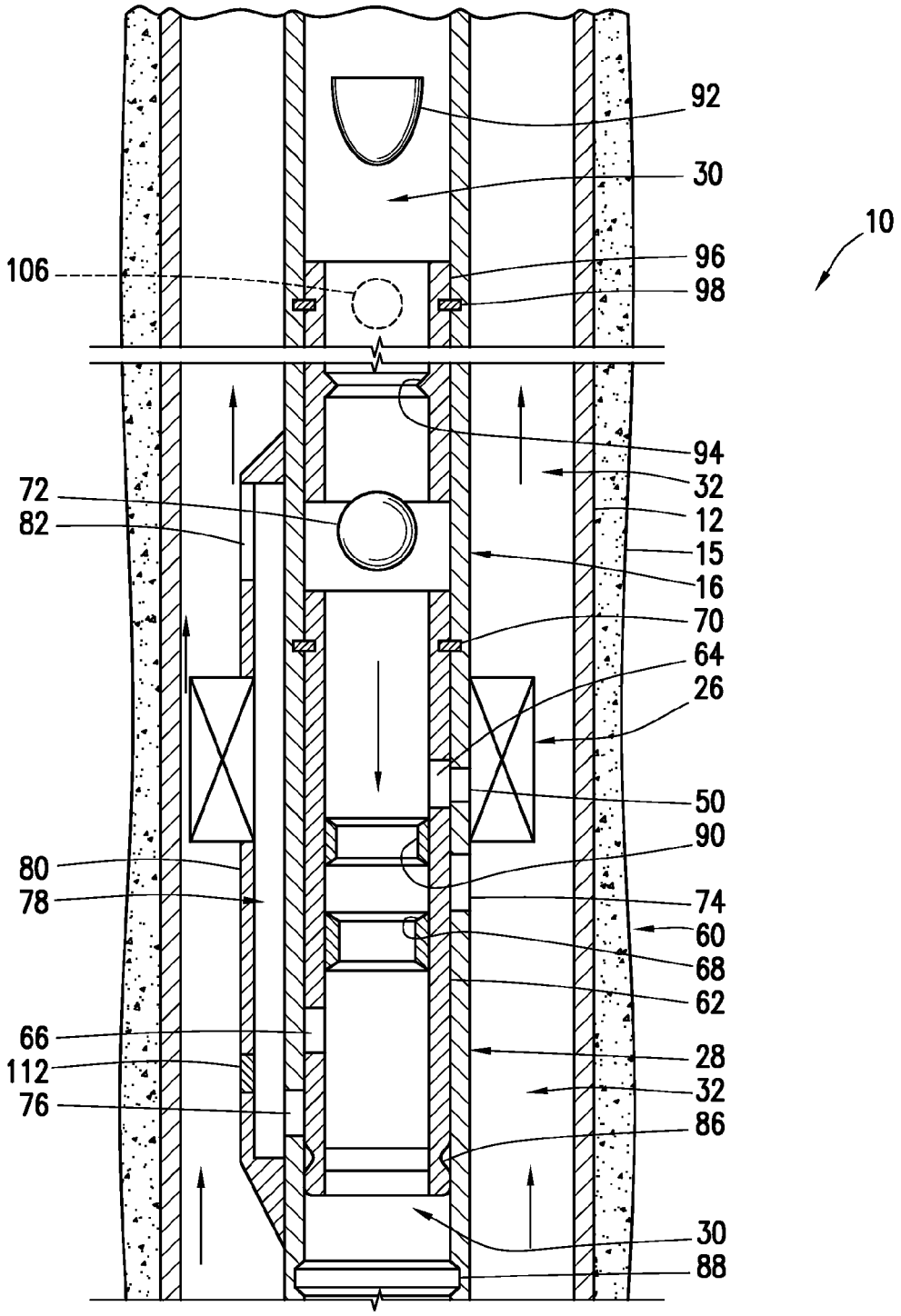
FIGS. 1A and 1B are schematic cross-sectional views of an exemplary reverse circulation cementing system according to an aspect of the embodiment, wherein the system is configured in a run-in configuration directing fluid along a conventional circulation path during run-in to hole.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

The description is primarily made with reference to a vertical wellbore. However, the disclosed embodiments herein can be used in horizontal, vertical, or deviated bores.

As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole.

The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

As used herein, "tubing string" refers to a series of connected pipe sections, joints, screens, blanks, cross-over tools, downhole tools and the like, inserted into a wellbore, whether used for drilling, work-over, production, injection, completion, or other processes. Similarly, "liner" or "liner string" and the like refer to a plurality of tubular sections, potentially including downhole tools, landing nipples, isolation devices, screen assemblies, and the like, positioned in the wellbore below the casing.

The disclosure addresses cementing a liner in a wellbore using reverse circulation for the cementing. More specifically, a method of reverse cementing of the liner is provided in conjunction with running in and setting of a conventional liner hanger or expandable liner hanger (ELH).

The embodiments discussed herein focus primarily on hydraulically actuated tools, including a running tool for setting or radially expanding an ELH, setting a radially expandable annular isolation device (such as a packer), operating downhole tools such as valves, sliding sleeves, collet assemblies, release and connection of tools downhole, etc. It is understood however that mechanical, electrical, chemical, and/or electro-mechanical operation can be used to actuate downhole tools and mechanisms. Actuators are used to "set" tools, release tools, open or close valves, etc. Here, a tubing string is run into a partially cased wellbore to hang an expandable liner, cement around the liner, hang the liner by radial expansion of an ELH, and release or disconnect the hung liner from the tool string. The string is retrieved to the surface.

Further, the disclosure focuses on reverse cementing of a liner in conjunction with an ELH. Those of skill in the art will recognize that the methods and apparatus disclosed can be readily modified for use with conventional liner hangers. For example, the various circulation control ports disclosed herein can be used to control circulation flow paths during run-in to hole, setting of the packer, reverse cementing, and pull out of hole. Where the disclosure relates to expansion of the ELH using an expansion assembly and cone, a conventional liner hanger embodiment can, for example, use the same or similar flow path diversion to set the conventional liner hanger. Alternately, the conventional liner hanger can be set, hydraulically or mechanically, using known methods and apparatus in the art.

Conventional liner hangers are typically secured within a wellbore by toothed slips set by axial translation with respect to the liner hanger mandrel or housing. As the slips are translated, they are moved radially outward, often on a ramped surface. As the slips move radially outward, they grippingly engage the casing. This type of arrangement is shown, for example, in which slips are radially expanded by riding up over cone elements disposed into the tubular body of the central mandrel. For disclosure regarding conventional liner hangers, see, for example, U.S. Pat. Nos. 8,113,292, to 8,113,292, published Feb. 14, 2012; U.S. Pat. No. 4,497,368, to Baugh, issued Feb. 5, 1985; U.S. Pat. No. 4,181,331, to Armco Inc., published Jan. 1, 1980; U.S. Pat. No. 7,537,060, to Fay, issued May 26, 2009; U.S. Pat. No. 8,002,044, to Fay, issued Aug. 23, 2011; each of which are incorporated herein in their entirety for all purposes. Features of these conventional liner hangers can be used in conjunction with the disclosed apparatus and methods herein.

Figure 1B:
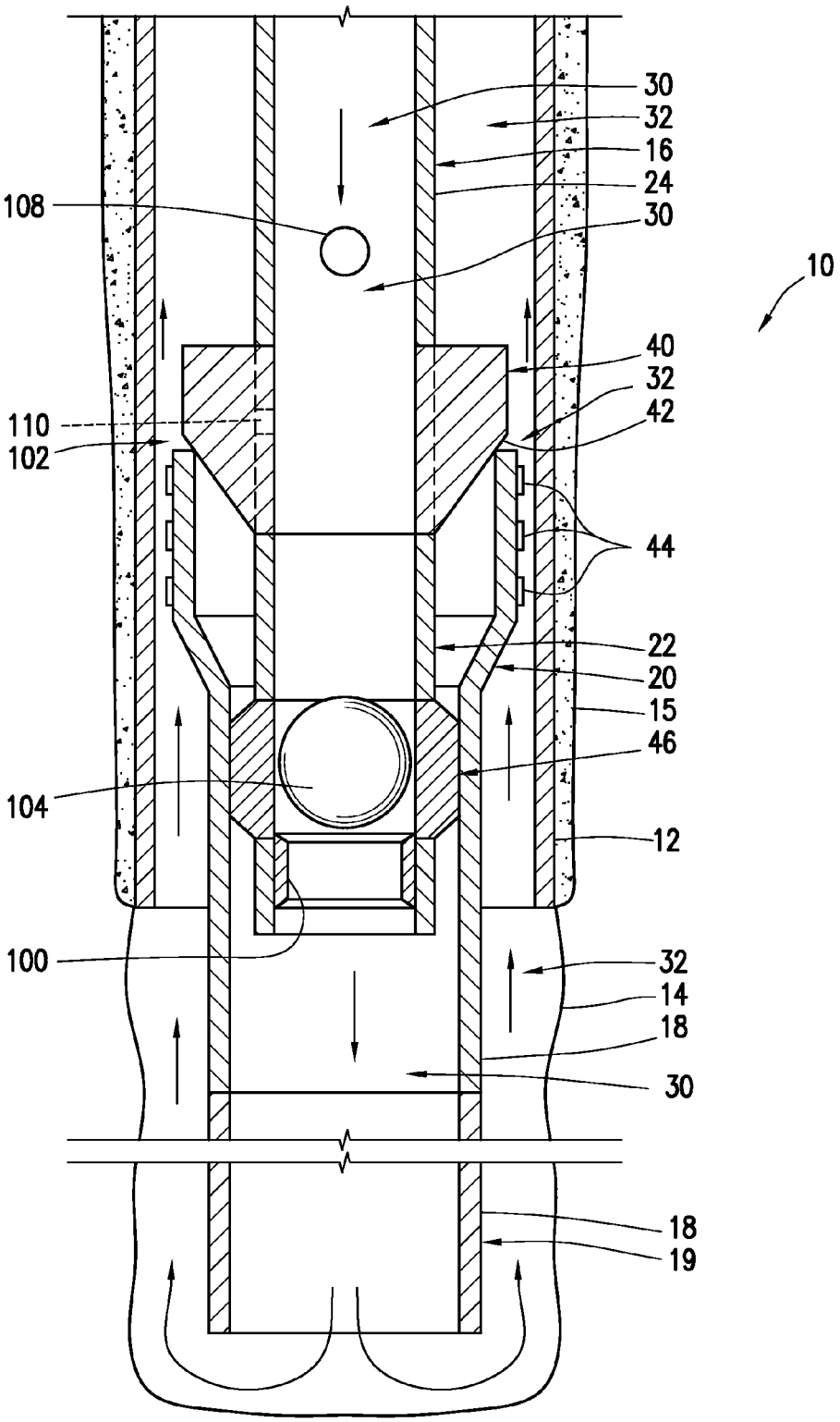

FIGS. 1A and 1B are schematic cross-sectional views of an exemplary reverse circulation cementing system according to an aspect of the embodiment, wherein the system is configured in a first or run-in configuration, directing fluid in a conventional circulation path during run-in to hole; FIGS. 1A and 1B also indicates a first ball drop to divert tubing fluid pressure to actuate an annular isolation device.

More specifically, FIGS. 1A and 1B are a schematic of a wellbore system generally designated as 10, having a cased portion with casing 12 positioned therein to a certain depth and an uncased or open hole wellbore 14 portion below. The casing 12 is cemented 15 in position in the annulus defined between the casing and wellbore. A tubing string 16 is run into the hole as shown and includes a liner or liner string 18, an expandable liner hanger (ELH) 20, a running or setting tool 22, a tubing string 24, an annular isolation device 26, and a reverse circulation tool 28.

Make-up and running of tubing strings, liner hangers, liners, etc., is known in the art by those of ordinary skill and will not be discussed in detail. During run in, conventional circulation, as indicated by arrows in FIGS. 1A and 1B, is employed such that fluid pumped down the interior passageway 30 of the tubing string 16, including through passageway sections defined in the running tool, ELH, and liner. Fluid exits the bottom 19 of the liner and circulates back to the surface (or a given depth uphole, such as at a cross-over tool) along the tubing annulus 32 defined generally between the tubing string 16 and the casing 12 and again between the liner 18 and wellbore 14. The tubing string is run-in to a selected position with the ELH 20 adjacent the casing 12 and the liner 18 extending into the open hole wellbore 14.

The system is in a first or run-in position in FIGS. 1A and 1B, wherein conventional circulation is permitted along a fluid path defined downwardly through the interior passageway 30 (or string ID), out the bottom 19 of the liner 18, and upwards along the tubing annulus 32.

The running tool 22 includes, in a preferred embodiment, a radial expansion assembly 40 having an expansion cone 42 operated by hydraulic pressure communicated through the internal passageway 30 upon increasing tubing pressure. An increase in tubing pressure, when flow through the expansion tool ID is blocked, drives the expansion cone through the ELH, thereby radially expanding the ELH into gripping and sealing engagement with the casing 12. Expansion assemblies are known in the art by those of ordinary skill and will not be described in detail herein or shown in detail in the figures. The expansion assembly can include additional features, such as selectively openable ports, fluid passageways, rupturable or frangible disks, piston assemblies, force multipliers, radially enlargeable expandable cones, fluid flow metering systems, etc.

Figure 4A:
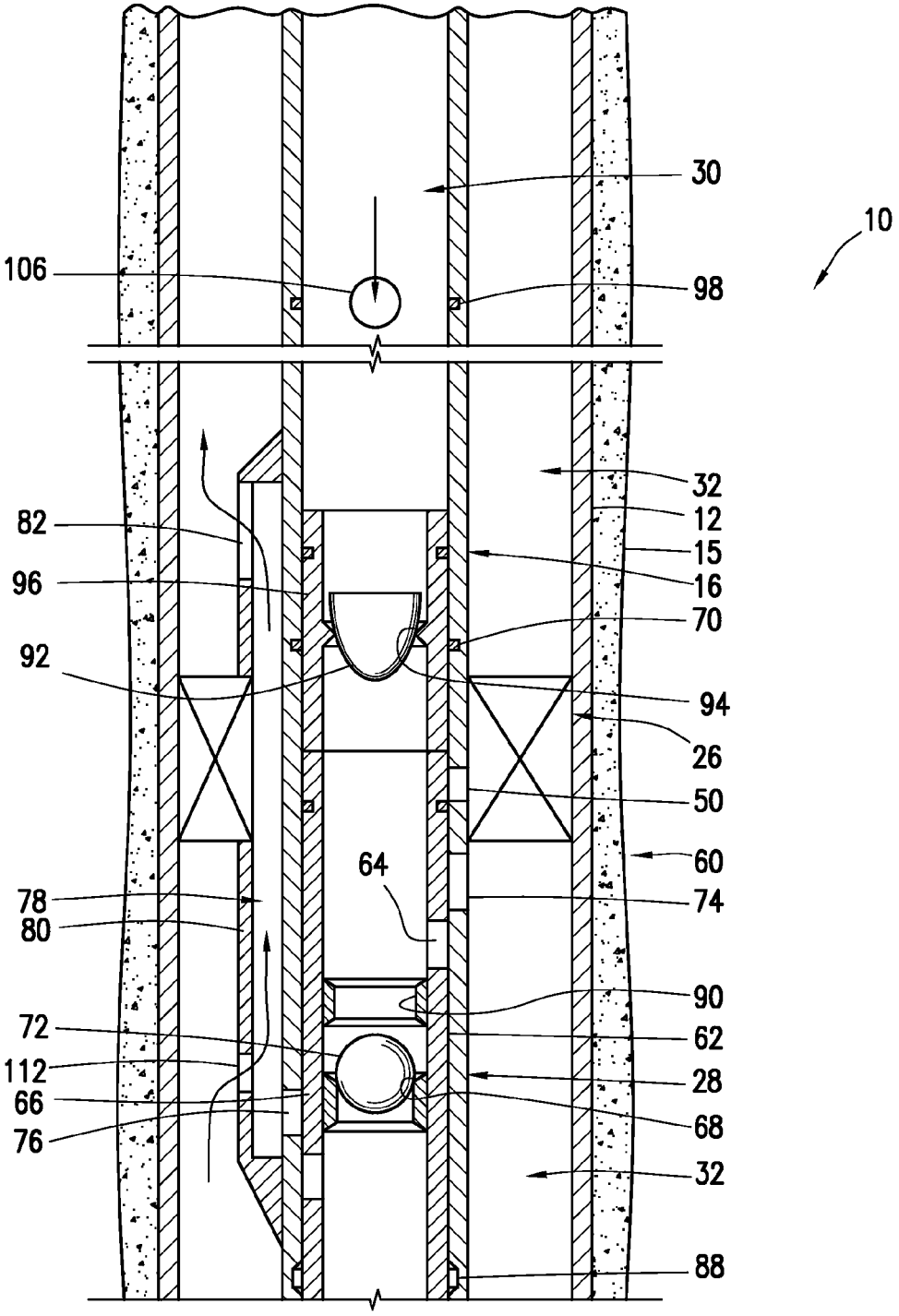
FIGS. 4A and 4B are schematic cross-sectional views of the exemplary reverse circulation cementing system according to FIGS. 1A, 1B, 2A, 2B, 3A, and 3B, wherein the ELH is in a radially expanded position, the system is configured for bypass circulation above the ELH, and the running tool is ready for disconnect and pull out of hole.
Figure 4B:
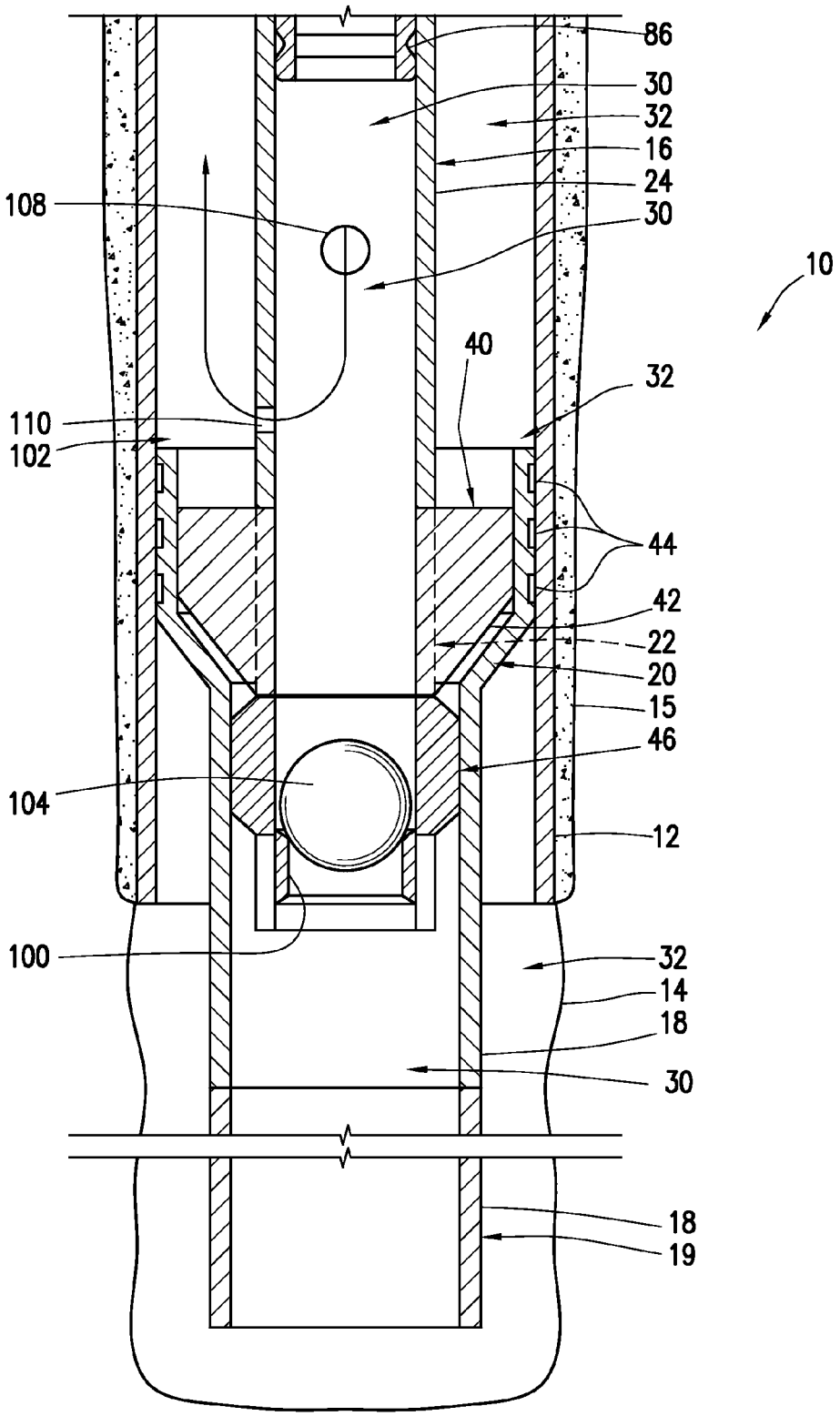

The ELH 20 includes a plurality of annular sealing and gripping elements 44 which engage the casing 12 when the ELH is in a radially expanded position, as seen in FIG. 4B, upon radial expansion of the ELH. The elements 44 can be of elastomeric, metal, or other material, can be of various design, and can comprise separate sealing elements and gripping elements. The ELH 20 can include additional features and devices, such as cooperating internal profiles, shear devices (e.g., shear pins), releasable connect or disconnect mechanisms to cooperate with the running tool, etc. The liner or liner string is attached to and extends downwardly from the ELH. The liner string can include various tools and assemblies as are known in the art.

The running tool 22 also preferably includes a release assembly or disconnect assembly 46 for selectively disconnecting the running tool 22 from the ELH 20. The release assembly 46 maintains the ELH and running tool in a connected state during run-in hole and radial expansion of the ELH. Upon completion of the operation, the locking assembly can be selectively disconnected, thereby allowing the running tool to be retrieved, or pulled out of hole, on the tubing string 16. The locking assembly, or disconnect assembly, can include a collet assembly, sliding sleeves, prop sleeves, cooperating lugs and recesses, snap rings, etc., as are known in the art.

An exemplary collet release assembly releasably attaches the tubing string 16 to the liner hanger 20 with, for example, collet lugs which cooperate with corresponding recesses defined on the interior surface of the liner hanger. The collet assembly is preferably axially and rotationally locked with respect to the liner hanger during run-in. The collet lugs can bear the tensile load due to the weight of the liner hanger and liner. A collet prop nut and prop sleeve, or similar device, maintains the collet in its run-in position until actuated to release the tool. The collet can be released by pulling up on the tubing string, manipulating a J-slot profile between the tubing string and prop sleeve, shearing a shearing mechanism, placing weight down and/or rotating the string, etc., to operate the collet release assembly and allow pulling out of hole of the string, leaving the expanded liner hanger in place.

Figure 2A:
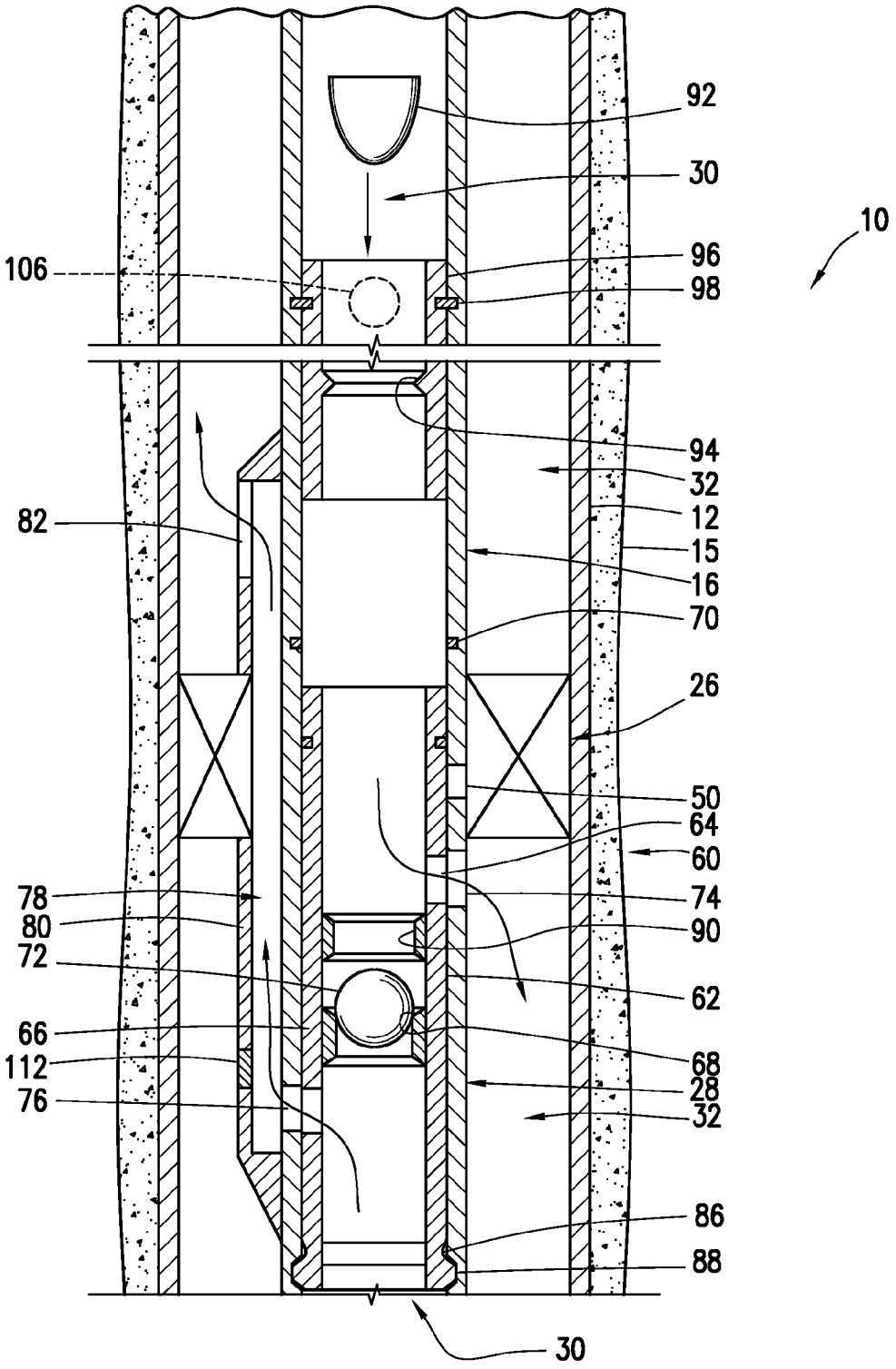
FIGS. 2A and 2B are schematic cross-sectional views of the exemplary reverse circulation cementing system according to FIGS. 1A and 1B, wherein the system is configured for reverse circulation cementing of the liner.

The tubing string 16 preferably includes an annular isolation device 26 for sealingly engaging the casing 12. During run-in, the annular isolation device is in a low radial profile position. Upon reaching target depth, the annular isolation device is radially expanded, as seen in FIG. 2A, into sealing engagement with the casing. The annular isolation device holds against pressure differential across the device, and prevents fluid flow through the annulus 32. In a preferred embodiment, the annular isolation device comprises a packer. Other such devices include packers, swellable packers, inflatable packers, chemically and thermally activated packers, plugs, bridge plugs, and the like, as are known in the art.

The annular isolation device seen in the figures is hydraulically actuated using tubing pressure applied through annular isolation device ports 50 which are aligned with sliding sleeve ports 64 during run-in and actuation. The ports 50 are closed after actuation of the annular isolation device by shifting of the sliding sleeve 62. Other embodiments do not close these ports, especially where the annular isolation device includes a mechanism for staying in the set position, such as a ratchet, latch, lock, etc. Preferably, the annular isolation device 26 is retrievable; that is, the device can be selectively "un-set" to a low profile position for pulling out of the hole. Retrievable packers are known in the art and can be released mechanically, such as by tubing string manipulation, hydraulically by application of tubing pressure, and otherwise.

In FIG. 1A, the annular isolation device is in a first or run-in position. Further, an exemplary isolation device port 50 is open. In the exemplary embodiment shown, sliding sleeve reverse circulation port 64 is aligned with the isolation device port 50. When flow through the ID passageway 30 is blocked, such as by a first drop-ball 72 positioned onto drop-ball valve seat 68, an increase in tubing pressure actuates and radially expands the annular isolation device to the set position, as seen in FIG. 2A.

Alternately, the annular isolation device port can comprise a valve which is movable between a closed and open position to allow setting of the device. The valve can be a mechanical, electrical, electro-mechanical, hydraulic, or chemically or thermally operated valve. The valve can be remotely operated by wireless or wired signal, by an increase in tubing pressure, by passage of time (e.g., a dissolving disk), by mechanical operation (e.g., manipulation of the tubing string), etc. The valve can have a sliding sleeve, rotating valve element, frangible or rupturable disk, a check valve or floating valve, etc., as is known in the art.

The reverse cementing tool or assembly 28 is discussed with regard to FIGS. 1A, 1B, 2A, 2B, 3A, 3B, 4A, and 4B, each of which show the exemplary tool in sequential positions or states. Like numbers refer to like parts throughout.

The exemplary reverse cementing tool 28 seen in the figures comprises a sliding sleeve valve assembly 60 having a sliding sleeve 62 defining reverse circulation ports 64, return ports 66, a drop-ball valve seat 68, optional seat 90, and having a release mechanism 70 (e.g., shear pins), a releasable holding mechanism, such as cooperating profiles 86 and 88, and drop-ball 72. The sliding sleeve valve assembly is seen in a first or run-in position. Reverse circulation port 64 is aligned with port 50 of the annular isolation device 26. When a drop-ball 72 is seated on valve seat 68, fluid pressure is diverted through ports 64 and port 50, and the isolation device 26 is set to a radially expanded position, seen in FIG. 2A, grippingly and sealingly engaging the casing 12.

Figure 2B:
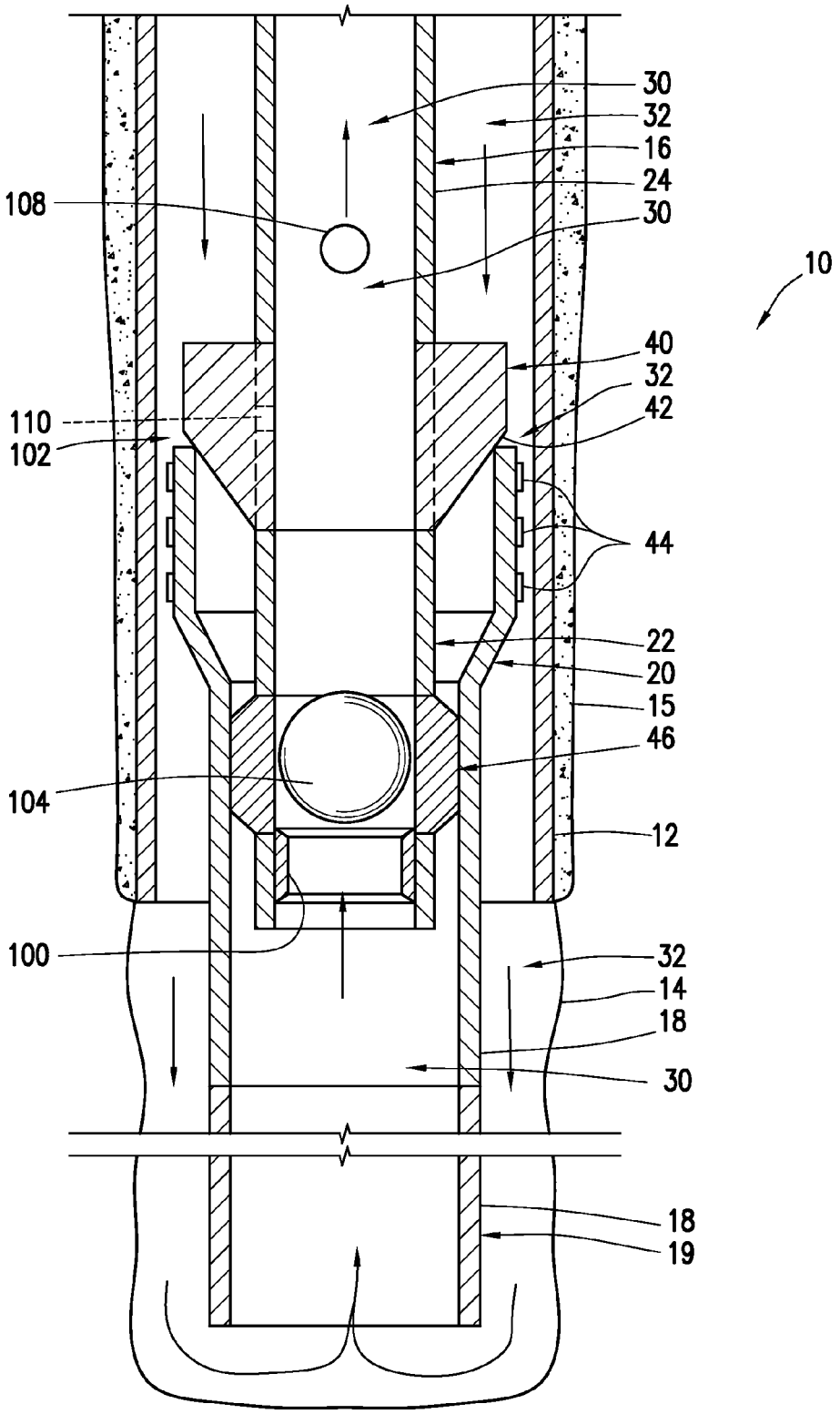

The sliding sleeve 62 is movable, upon shearing of the release mechanism 70, shown as exemplary shear pins. With a ball seated at valve seat 68, after setting of the isolation device 26, increased tubing pressure shears the pins, thereby releasing the sliding sleeve to move to a second or reverse circulation position, as seen in FIGS. 2A and 2B. In this position, the reverse circulation ports 64 align with tubing cross-over or OD ports 74 defined through the wall of the tubing 16.

Cement and other fluids flow from the interior passageway 30 above the valve seat 68 into the tubing annulus 32. The cement flows down the annulus 32 and returns upward through the interior passageway 30 from the lower end of the liner 18.

Return ports 66 are aligned with bypass ports 76 in the wall of tubing 16, allowing fluid to flow from the interior passageway 30 below the valve seat 68 to an annular isolation device bypass passageway 78. Fluid thereby bypasses the annular isolation device 26. In the preferred embodiment shown, the fluid flows through bypass passageway 78 defined by housing 80 and exits back into the annulus 32 above the isolation device 26 by annulus ports 82. Alternate arrangements of the bypass passageway and ports will be readily apparent to those of skill in the art. For example, the bypass passageway can be annular, have multiple passageways, be housed inside the tubing 24, etc.

The reverse cementing tool 28 is designed to alter a conventional circulation path to a reverse circulation path. The liner is cemented using the reverse circulation path by pumping cement down the tubing interior passageway, past the isolation device, and into the tubing annulus below the isolation device. The cement and other pumped fluids are forced downward along the annulus to the bottom of the wellbore and thence through the lower end of the liner and upward along the interior passageway. The interior passageway is closed at valve seat 68, diverting flow through return ports 66 of the sliding sleeve 62 and aligned bypass ports 76 through the wall of tubing 16. Fluid then flows upward, along bypass passageway 78 and tubing annulus 32 above the isolation device 26 to the surface.

Cementing operations are known in the art and not described in detail herein. Cement 15 is pumped into the annulus 32 around the liner 18 where it will set. The liner is cemented into position in the wellbore 14. "Cement" as used herein refers to any substance, whether liquid, slurry, semi-solid, granular, aggregate, or otherwise, used in subterranean wells to fill or substantially fill an annulus surrounding a casing or liner in a wellbore which sets into a solid material, whether by thermal, evaporative, drainage, chemical, or other processes, and which functions to maintain the casing or liner in position in the wellbore. Cementing materials are known in the art by persons of skill.

Figure 3A:
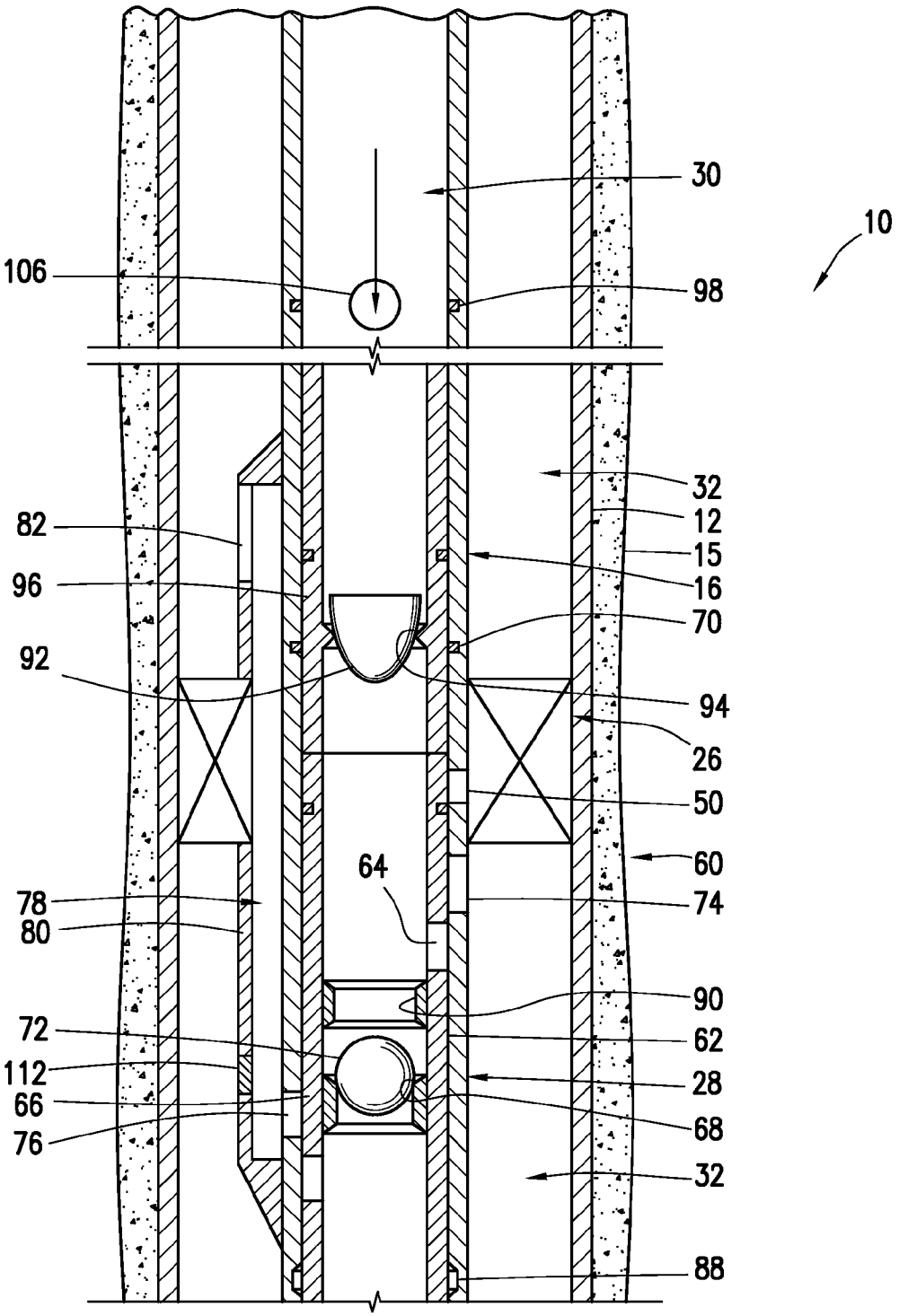
FIGS. 3A and 3B are schematic cross-sectional views of the exemplary reverse circulation cementing system according to FIGS. 1A, 1B, 2A, and 2B, wherein the reverse circulation path is closed and a pressure communication bypass to the liner hanger expansion assembly is open.
Figure 3B:
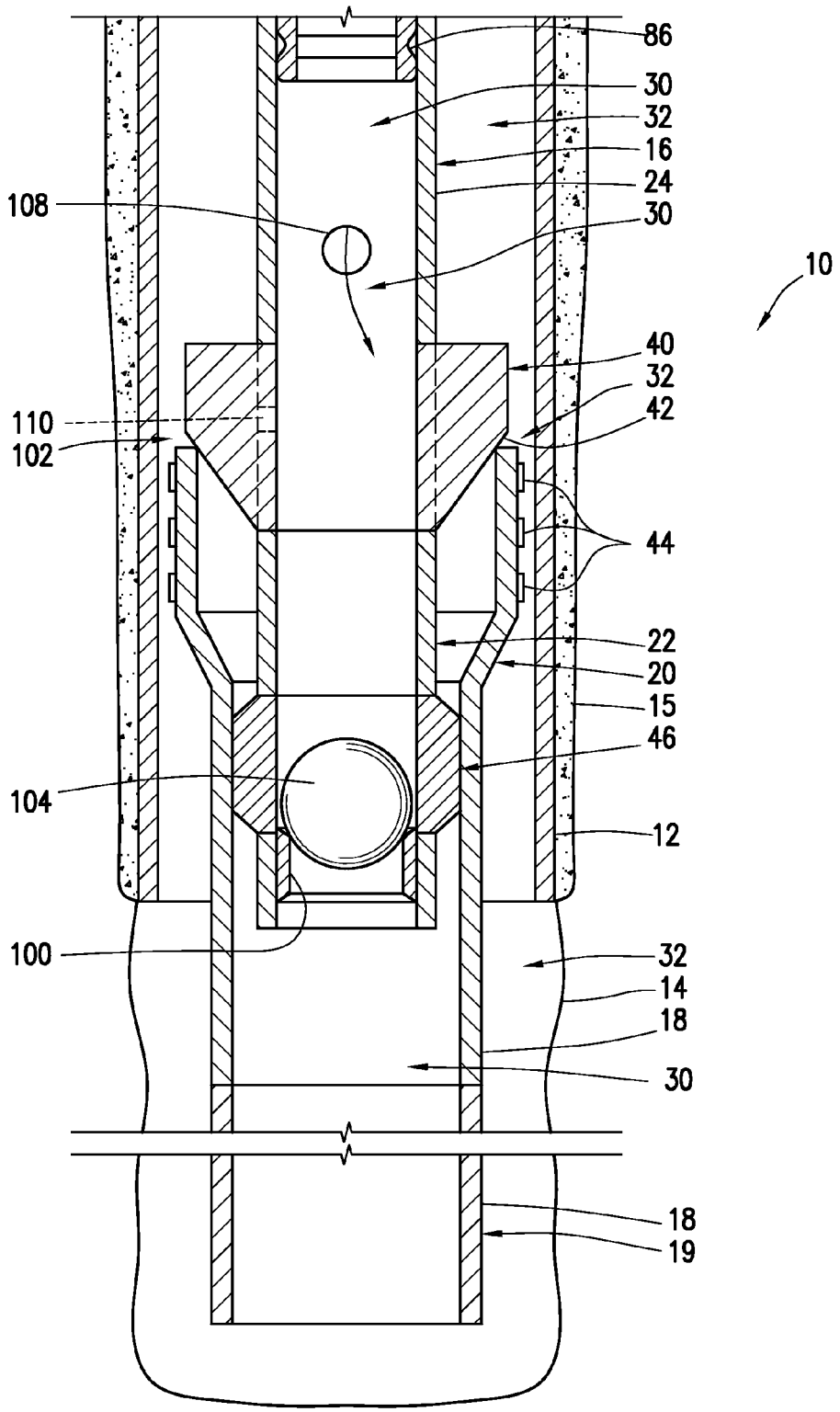

The exemplary reverse circulation apparatus can be closed upon completion of cementing operations and the tool placed into a conventional circulation pattern. In one embodiment, the sliding sleeve 62 is moved to a third or conventional circulation position, as seen in FIGS. 3A and 3B.

The sleeve 62 is maintained in the second or reverse circulation position during cementing and then moved to a third position. The sleeve 62 can be maintained in the second position by various mechanisms known in the art for selectively and releasably supporting elements in relation to one another while allowing fluid flow therethrough. For example, snap rings, cooperating profiles or shoulders (e.g., profiles 86), interconnected or telescoping sleeves, cooperating pins and slots (e.g., J-slots), shear mechanisms, collet assemblies, dogs, lugs or the like, etc. Selective release of the sleeve can be achieved through mechanisms and methods known in the art, such as, for example, increasing tubing pressure, manipulation of the tubing string (e.g., weight down, rotation), electro-mechanical devices (battery or cable powered) upon an activation signal (wireless or wired), chemically or thermally activated mechanisms or barriers, etc.

In one embodiment, the previously dropped ball 72, seated at valve seat 68, operates to move the sleeve 62 past the cooperating profile 88 upon (again) pressuring up the tubing fluid. Alternately, an additional dropped ball, of the same or different size, can be seated on an additional valve seat 90, with increased tubing pressure actuating the sleeve. As another alternative, the first drop-ball 72 can be mechanically released from the ball valve seat 68, such as by extruding the ball past the seat in response to tubing pressure, enlarging the valve seat by retraction of seat elements, dissolving or chemically dispersing the ball, etc. A second drop-ball can then be seated on the same or another valve seat.

Alternatively, and in a preferred method, a cement dart 92 can be run through the tubing string interior passageway upon completion of cementing the liner annulus. Running of a dart is typical at the end of a cement job. The dart 92 seats on a valve seat 94 defined in an additional and separate sliding sleeve 96. Upon increasing tubing pressure, shear mechanisms 98, shown as shear pins, are sheared and the sleeve 96 slides downward, either to a position covering the cross-over 74 and bypass ports 76, or sliding downward to contact and move the lower sliding sleeve 62 into a position closing those ports. Other methods and apparatus for closing the reverse circulation ports will be recognized by those of skill in the art.

In a preferred embodiment, the ELH is radially expanded into sealing engagement with the casing upon completion of the cementing operation. This can be accomplished in many ways, as those of skill in the art will recognize. In a preferred embodiment, an expansion cone 42 is hydraulically driven through the ELH by increasing tubing pressure to operate one or more piston assemblies (not shown). Such an assembly is known in the art and can include various other features and mechanisms such as metering devices, force multipliers, stacked piston assemblies, etc.

Expandable liner hangers and setting equipment and services are commercially available through Halliburton Energy Services, Inc.

Tubing pressure is conveyed to the expansion assembly 40 by fluid passageway. In one embodiment, the drop-ball 72, dart 92, any additional drop-balls, etc., are removed from the interior passageway 30. These devices can be removed by any known method of the art, including but not limited to reverse flow to the surface, mechanical release from or extrusion through the valve seat and movement to the wellbore bottom or other convenient location, dissolving or chemically dispersing the ball, etc. Removal of the drop-balls and dart opens the interior passageway 30 to fluid flow and allows communication of tubing pressure.

In another embodiment, a drop-ball or dart is moved downward through the passageway 30 onto a valve seat 100 defined in the expansion assembly 32 allowing a pressure-up of the tubing fluid to drive the expansion cone 42.

In yet another embodiment, an expansion assembly valve assembly 102 is employed. A preferred valve has a valve seat 100 onto which is positioned a caged ball 104 carried in the running tool. The caged ball is released from its run-in position, in which fluid freely moves past the caged ball, and moved to a seated position on valve seat 100. Pressuring-up on the tubing fluid then causes the ball 104 to seat at valve seat 100, thereby blocking fluid flow through the expansion tool interior passageway. The fluid pressure is communicated to an actuation assembly, such as a piston assembly, which drives the expansion cone 42 downwardly through the ELH, thereby radially expanding the ELH.

The caged ball can be carried in a side-pocket defined in the tubing string, in a tool positioned above the expansion cone for that purpose, in a cage which allows fluid flow past the ball, etc. Caged and releasable balls are known in the art by those of requisite skill. The caged ball can be released by methods and apparatus known in the art, including but not limited to, hydraulically, mechanically, electro-mechanically, or chemically or thermally actuated mechanisms, by removal or dissolution of a caging element, upon wireless or wired command, powered by local battery or remote power supply by cable, etc.

In another embodiment, as seen in FIGS. 1A, 1B, 2A, 2B, 3A, 3B, 4A, and 4B, sliding movement of sleeve 96 (or any other sleeve) opens a previously closed bypass port 106 allowing tubing fluid and pressure to be conveyed through a bypass passageway (not seen) to a similar port 108 above the expansion assembly. Fluid pressure is communicated through the bypass ports and bypass passageway, and thereby bypasses the drop-ball 72 and/or dart 92.

After completion of radial expansion of the ELH, it is desirable to establish a flow path allowing passage of fluid downward through the interior passageway 30 (and optionally the bypass ports 106 and 108 and associated bypass passageway) and then through a cross-over port 110 in the tubing wall into the annulus 32 above the now-expanded ELH. Fluid flows upward in the annulus 32 and bypasses the set annular isolation device 26 through bypass passageway 78, for example. An additional valve assembly 112 is opened allowing access from the annulus to the bypass passageway 78. The valve may be of any known design and operation, as known in the art and described elsewhere herein. The valve can be a check valve, one-way valve, or frangible barrier, for example.

In the embodiment seen in the figures, the expansion cone 42 is driven a stroke distance to expand the ELH into engagement with the casing. At or near the end of its stroke, the cross-over port 110 is opened in the tubing wall above the now-expanded ELH allowing fluid communication to the annulus 32. Alternative arrangements, ports, actuation methods and devices, etc., will be apparent to those of requisite skill.

The embodiment seen in FIGS. 1A, 1B, 2A, 2B, 3A, 3B, 4A, and 4B, present several valve assemblies for controlling fluid and pressure communication, for opening and/or closing valves, and for providing or denying access to fluid bypasses and annulus. Some of the valve assemblies are sliding sleeve valves and dropped or released ball valves. It is understood that the valve assemblies in the figures can often be replaced with other types of valve. Check valves, rupture disk, frangible disk, and other removable barrier valves, one-way and two-way valves, flapper valves, etc., as are known in the art can be used for some or all of the valves in the figures. The valves presented in the figures include sliding sleeve valves at 50 and 76, drop-ball or dart valves at 72 and 92, caged or released ball valve at 104, and a check or other valve at 112.

Additionally, various actuation or activation methods and mechanisms are known in the art and can be employed at various locations, as those of skill will recognize. The valves can be operable by hydraulic, mechanical, electro-mechanical, chemically or thermally triggered valves can be used. The valves can be triggered or actuated in response to wireless or wired signal, time delays, chemical agents, thermal agents, electro-mechanical actuators such as movable pins, string manipulation, tubing pressure, flow rates, etc., as those of requisite skill will recognize. The valves in the figures are largely hydraulically operated by changes in tubing pressure. The valve at 112 can be a removable barrier or disk valve, an electro-mechanical valve, or a check valve of some kind.

Further, multiple ports are called out in the figures. Ports are known in the art and can take various shape and size, can include flow regulation devices such as nozzles and orifices, and can have various closure mechanisms (e.g., pivoted cover).

Still further, various bypasses and passageways are described in relation to the figures. Those of requisite skill will recognize that the locations of the passageways and ports thereto, the shapes and paths of the passageways, and other passageway characteristics can take various forms. Such passageways can be annular, substantially tubular, or of other shape.

The sliding sleeve valves are shown of a basic construction. Other arrangements will be readily apparent to those of skill in the art, including sliding sleeve valves wherein the ball valve element remains in a stationary seat and diverts flow to operate a separate sliding sleeve, etc.

Figure 5:
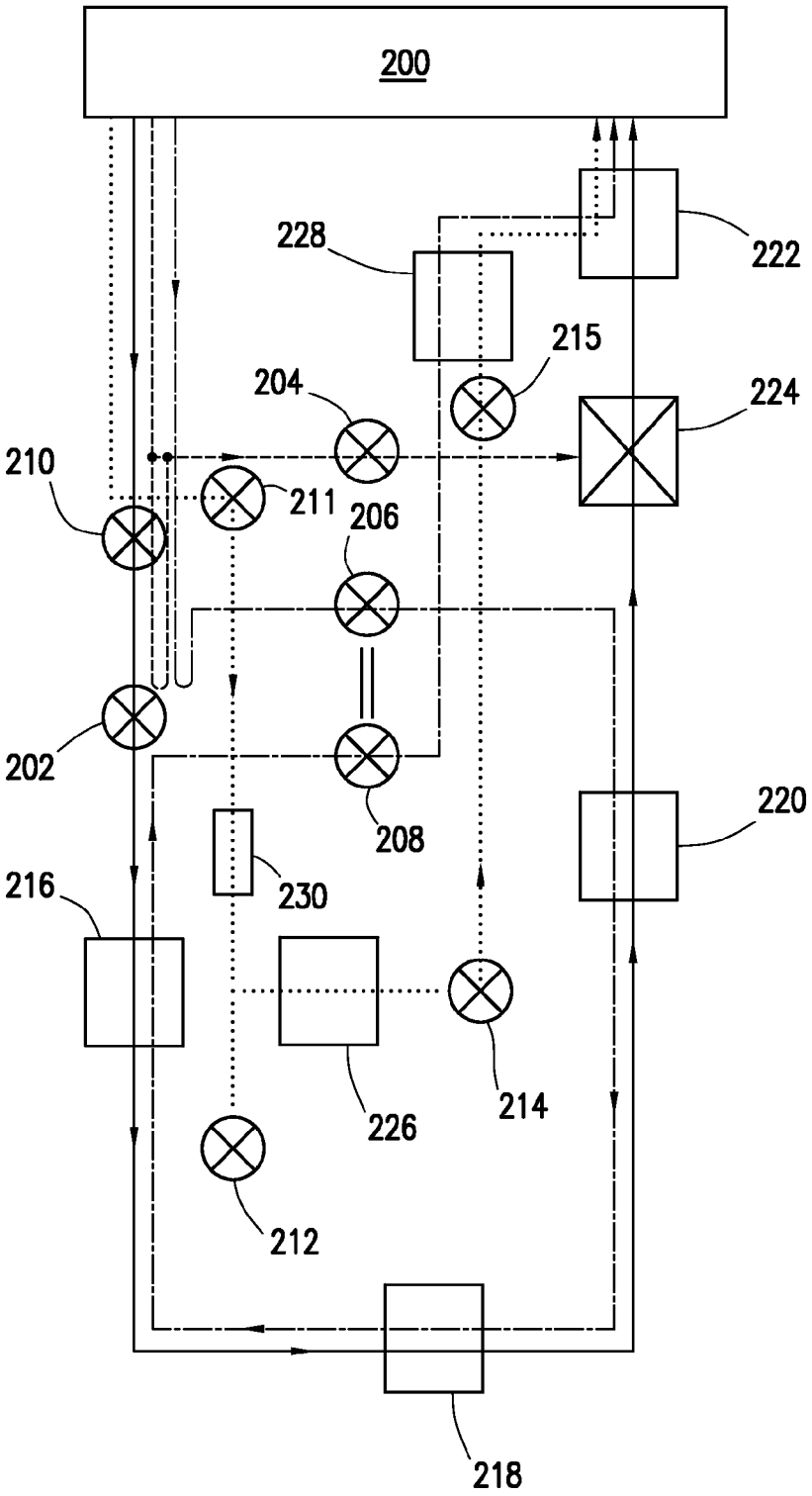
FIG. 5 is a diagram of exemplary flow paths and valve assemblies for use in an exemplary reverse circulation cementing method according to an aspect of the invention.

FIG. 5 is a diagram showing the valves operated, and the fluid and pressure communication paths used, during exemplary reverse circulation cementing operation according to an aspect of the disclosure. The valves can be of various design, including drop-ball valves, pumped-in dart valves, check valves, frangible or rupturable valves, sliding sleeve valves, etc., as mentioned herein and as known in the art. The flow paths are defined by various passageways and ports in the exemplary embodiments discussed above. Alternative flow paths can be used, such as interior or exterior bypasses and passageways, annular or tubular passageways, etc. Further, some of the passageways can be used during multiple configurations, in whole or in part. Also, passageways, ports, and valves in the preferred embodiments can be replaced or even eliminated in some alternatives. For example, the ports 106 and 108 and associated bypass passageway may not be necessary where, for example, the drop-ball(s) and/or dart(s) are removable from the interior passageway 30. Exemplary ports are illustrated in the figures and can take alternative forms, such as radial or axial ports, ports of other orientation, ports with multiple apertures, having filters, flow regulators and orifices, etc.

Turning to FIG. 5, the surface 200 is indicated and can include any type of surface equipment, the wellhead, etc. Valves or valve assemblies 202, 204, 206, 208, 210, 211, 212, 214, and 215 are shown representatively. Not all of the valves need be used, and additional valves can be added. As stated above, the valves can be of various type. Passageways and features are indicated for reference, including interior passageway or tubing ID passageway 216, liner bottom 218, the liner annulus (below the packer) 220, the casing annulus (above the packer) 222, the packer 224, the radial expansion assembly 226, a bypass passageway 228 which bypasses the packer 224, and a bypass passageway 230 to the expansion assembly, which bypasses the (closed) tubing ID passageway.

During run-in, a first circulation path is established wherein fluid flows from the surface 200 through the tubing ID passageway 216, out the liner bottom 218, and upwards through the annulus 220 and 222. Note that the packer (annular isolation device) 224 is not yet set. This is a conventional circulation path: down the tubing ID, up the annulus. The tubing string is run-in to depth with the ELH adjacent the lower end of the casing. Initially, valves 202 and 210 are open, and packer 224 is not set in the annulus. Also, preferably valves 206, 208, and 214 are closed initially, while valves 204 and 212 can be open.

A second circulation path is established to set the packer 224. (The packer can be any known annular isolation device as explained elsewhere herein.) Valve 202 is closed and fluid from the surface 200 cannot flow through (the entire length) of the tubing ID passageway 216. Tubing pressure is built up and communicated through valve 204 to the expandable packer 224. The pressure is used to radially expand and set the packer into sealing and gripping engagement with the casing. Valve 204 is optional as packers can have mechanical features for maintaining a set position and be largely unaffected by subsequent changes in tubing pressure.

In the exemplary embodiment disclosed above herein, the valve 202 is a drop-ball valve positioned in a sliding sleeve. The drop-ball seats in the sliding sleeve, blocking fluid flow through the interior passageway. The ball can be dropped from the surface or from a cage in the tubing string for that purpose. Tubing pressure is communicated to and sets the packer 224. Other valve types can be used here. The optional valve 204 is preferably initially open, allowing pressure communication to the packer.

A third circulation path is established to cement the liner in the wellbore. The third circulation path is a reverse circulation cementing path. The path has fluid from the surface 200 flowing into the tubing ID passageway 216 but prevented from continued flow along the tubing ID passageway by the still-closed valve 202. In a preferred embodiment, the resulting tubing pressure increase is used to open both the reverse circulation valve 206 and reverse circulation return valve 208. Alternately, these valves can be opened separately and by separate actuation methods or apparatus. Once open, fluid flows through the reverse circulation valve 206 and into the liner annulus 220 below the packer. The fluid, bearing or comprising cement, flows along the liner annulus to the bottom of the liner 218 and then upward through the tubing ID passageway 216. Since valve 202 is closed, fluid is diverted through the reverse circulation return valve 208 and through bypass passageway 228. The bypass passageway 228 provides a fluid path to the casing annulus 222 and bypasses the packer 224.

In the exemplary embodiment disclosed above herein, the valve 202 is a drop-ball valve which, upon sufficient build-up of tubing pressure, actuates a sliding sleeve valve assembly. The sliding sleeve can be maintained in an initial position wherein the valves 206 and 208 are closed. Shear pins or the like can be used to hold the sleeve. Upon shearing the pins, the sleeve moves from its initial closed position, with valves 206 and 208 closed, to an open position, with valves 206 and 208 open. The valves 206 and 208 are simultaneously operated by a single actuator (sleeve) in response to a single application of actuating force (pressure-up) n the preferred embodiment. In essence, these valves can be thought of as a single valve, as indicated in the FIG. 5 by the double line) with multiple ports being opened. (Note that the ports do not both direct fluid flow from the tubing ID passageway.)

In the preferred embodiment, the dropped ball seats itself within, and moves with, the sliding sleeve, however, other arrangements can be used. For example, the dropped ball can seat (in a stationary sleeve) and block fluid, diverting the pressure build-up to actuate reverse circulation valves 206 and 208. The valves 206 and 208 need not be sliding sleeve valves and can be of various valve type.

A fourth circulation path is established upon completion of the cementing operation. Valve 210 is closed and tubing pressure builds. Upon sufficient pressure, the valve 211 is opened, allowing fluid from the surface 200 to flow through the tubing ID passageway, through valve 211 and through a passageway 230 to the expansion assembly 226. An optional valve 212, initially open in a preferred embodiment (but which can be initially closed), is closed in response to tubing pressure, and diverts fluid pressure to actuate the radial expansion assembly, thereby radially expanding the ELH into gripping and sealing engagement with the casing. For example, the valve 212 moves to a closed position, thereby forcing fluid and pressure through a piston assembly which drives the expansion cone.

In the exemplary embodiment disclosed above herein, the valve 210 is a dart-operated valve. The dart is run through the tubing ID passageway from the surface upon completion of pumping cement. The dart seats on a corresponding valve seat defined in the tubing ID, thereby blocking fluid flow therethrough. Tubing pressure is built-up in response until a sliding sleeve valve is actuated (e.g., upon the shearing of pins, overcoming a latch or cooperating profile mechanism, etc.). The sliding sleeve moves, thereby opening valve 211 and allowing fluid flow and tubing pressure communication through passageway 230. The tubing pressure is now directed to valve 212, a caged-ball valve in the embodiment above herein. The caged ball is dropped or moved to seal against a seat in the expansion assembly. Fluid pressure is now conveyed to the expansion assembly, for example, through a piston assembly to drive the expansion cone. Other arrangements are possible.

Where a conventional liner hanger is employed, the valve 212, expansion assembly 226, and/or valve 214 may be unnecessary or can be replaced with different valve and tool arrangements. For example, after cementing is complete, the valve 210 is closed (just as in the ELH version) and fluid pressure conveyed through a liner hanger setting passageway to the conventional liner hanger setting tool. For example, the fluid pressure can operate or actuate an axial compression of a slip and/or sealing element assembly, thereby causing radial expansion of the slips and sealing element into engagement with the casing. Alternate embodiments will be apparent to those of skill in the art.

Upon completion of radial expansion of the ELH by the expansion assembly 226, a valve 214 is opened allowing fluid flow back to the surface 200 through the bypass passageway 228. The valve 214 in the embodiment above herein is a sliding sleeve valve, wherein the sliding sleeve takes the form of a moving part of the expansion assembly (for example, the cone). Other arrangements are possible here as well. A valve 215 may be needed between the expansion assembly and the packer bypass passageway 228. In a preferred embodiment, valve 215 is a check-valve, one-way valve, or rupture valve. The valve 215 preferably prevents fluid flow from the bypass passageway 228 into the expansion assembly 226 prior to actuation of the assembly. Valve 215 is optional depending on the tool design. The preferred embodiment disclosed above herein utilizes a valve 215 (at valve 112) to prevent fluid flow (and pressure loss) across the bypass passageway 78.

Figure 6:
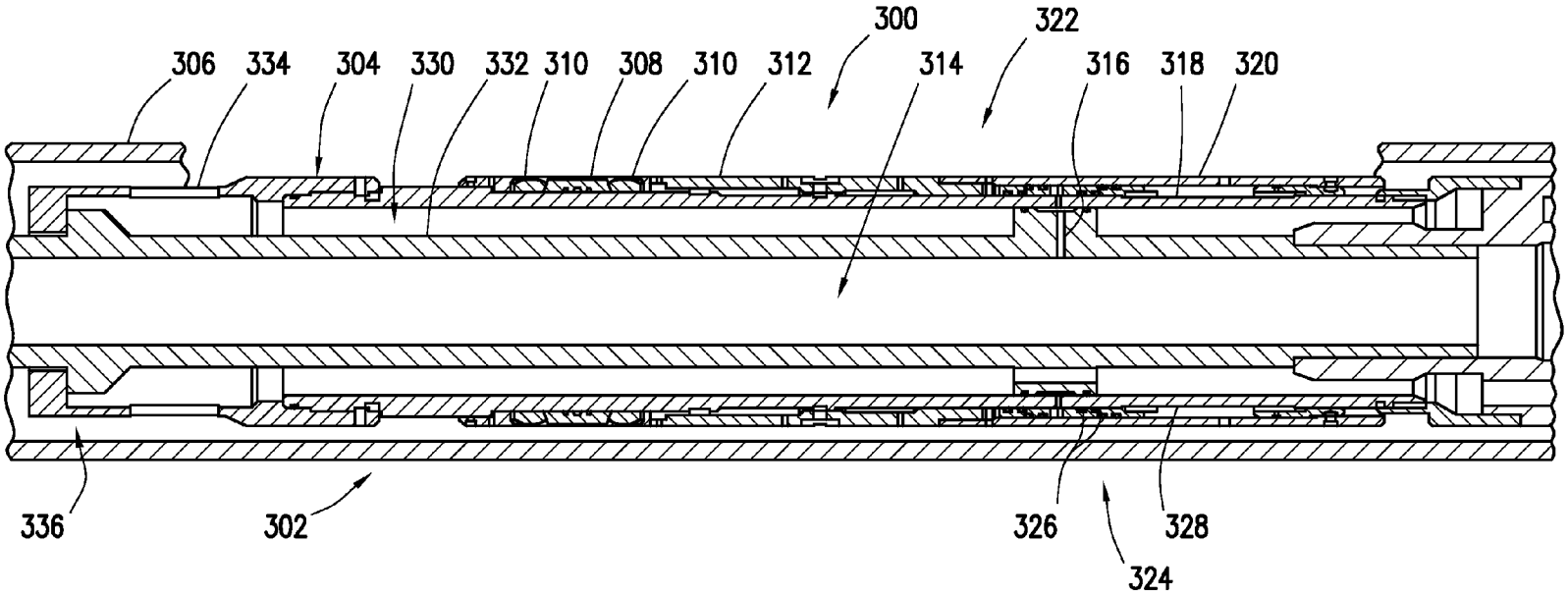
FIG. 6 is an annular isolation device 300 and cross-flow mandrel 302 positioned in a tubing section 304.
Figure 7:
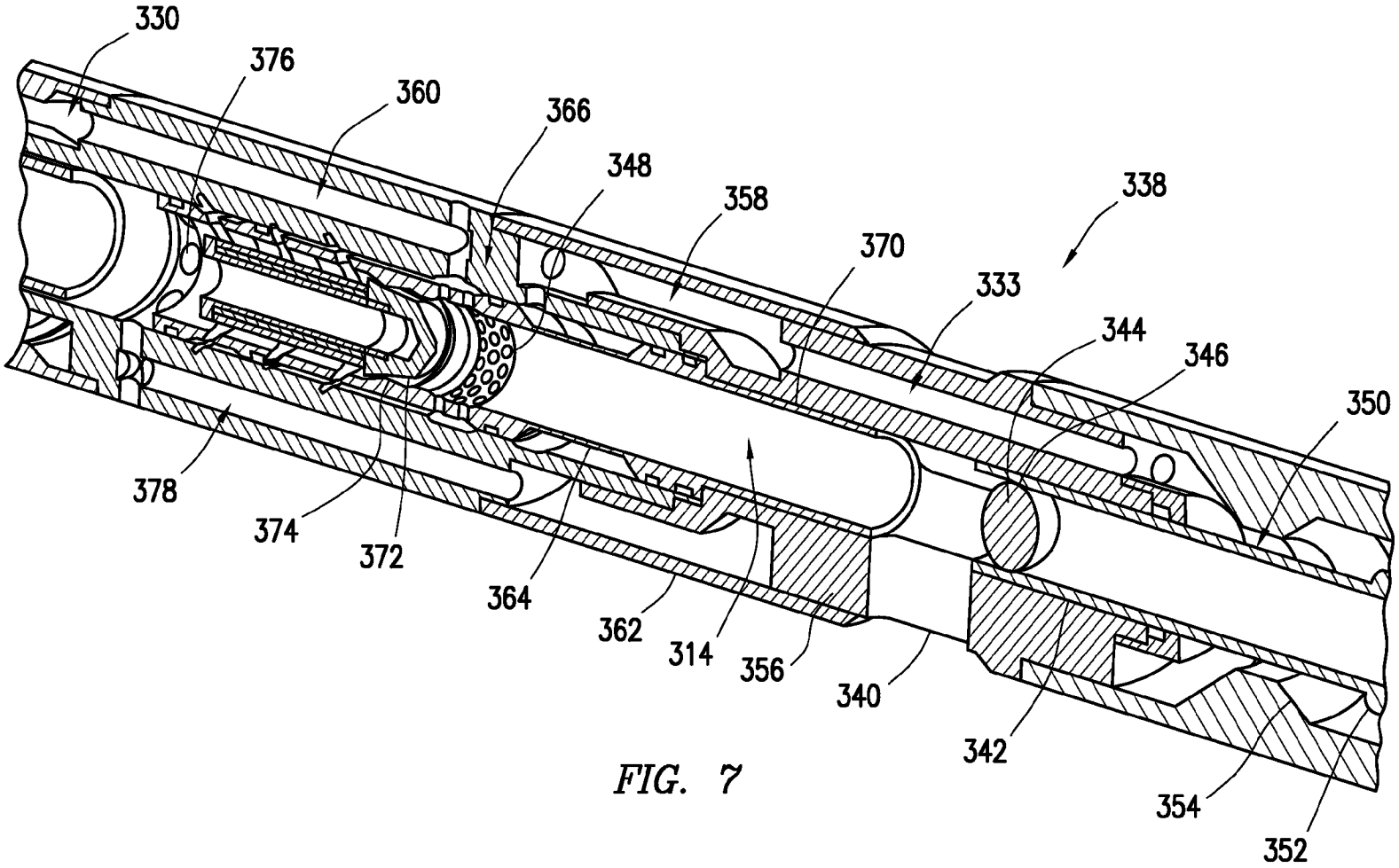
FIG. 7 is an isometric view in cross-section of an exemplary reverse circulation valve assembly according to an aspect of the disclosure.
Figure 8:
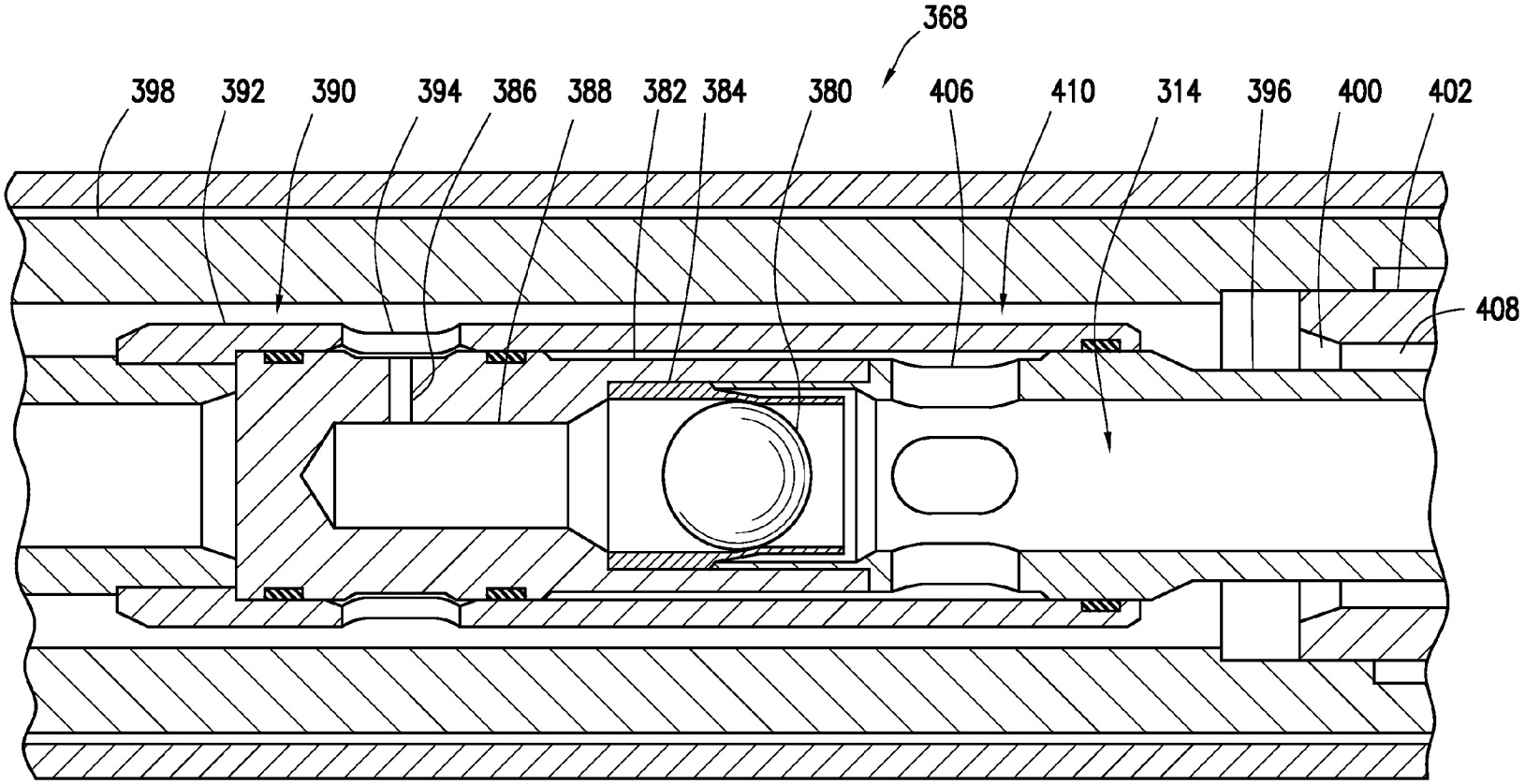
FIG. 8 is an elevational cross-sectional view of an exemplary caged-ball housing and valve assembly according to an aspect of the disclosure.

FIGS. 6-8 are detail views in partial cross-section of exemplary assemblies of the system according to aspects of the disclosure.

FIG. 6 is an annular isolation device 300 and cross-flow mandrel 302 positioned in a tubing section 304. The tubing section is positioned within casing 306. The annular isolation device is a packer having an elastomeric sealing element 308 and annular support rings 310 for axially compressing and radially expanding the elastomeric element into contact with the casing. The lower annular ring 310 is forced upward by piston 312 which is driven by tubing pressure conveyed from interior passageway 314, port 316, and piston annulus 318. Movement of the piston also causes relative movement of the sleeve 320 of the mechanical locking assembly 322. This movement cause ratchet mechanism 324, with ratchet teeth 326 defined on the interior of the sleeve and the exterior of the packer housing 328, to lock the packer in a set position.

Also in FIG. 6 is seen a cross-flow device having a bypass passageway 330 defined between the mandrel 332 and the packer housing 328. Ports 334 provide fluid communication between the bypass passageway and the casing annulus 336.

The elements called out in FIG. 6 correspond to a great degree with those seen in FIG. 1A but in greater detail. Like numbers are not, however, used, but reference to the earlier figures and description will serve to enhance understanding of FIG. 6.

FIG. 7 is an isometric view in cross-section of an exemplary reverse circulation valve assembly according to an aspect of the disclosure. Initially, reverse circulation ports 340 are closed by the sliding sleeve 342. In the initial position, conventional circulation occurs. The sleeve is seen in a shifted position in response to the drop-ball 344 sealing against valve seat 346 defined in the sleeve. The sleeve initially covers the reverse circulation ports, but, when shifted, opens the reverse circulation ports 340 such that cement and fluid flows downward along the interior passageway 314, through the ports, and into the (casing or liner) annulus defined exterior to the assembly. Further, in the initial position, the sleeve 342 closes annular reverse circulation return port 350, as cooperating valve surfaces 352 mate. After the ball 344 is dropped and seated, the sleeve 342 shifts in response to tubing pressure, thereby opening reverse circulation ports 340 and return annular port 350. Cement-bearing fluid can now flow down the interior passageway, out through the reverse circulation ports, and into and down the liner annulus (below the packer, already set). The cement is flowed into position and left to set-up, filling the liner annulus and cementing the liner in place. Return fluid flows through the liner bottom and upward through the interior passageway in the liner, through the annular return port 350, through 333, and along the bypass passageway 330. The bypass passageway 330, in the embodiment shown, has sections in the reverse circulation valve body 333, in an annular space 358, and along a passageway 360 across the packer assembly.

Also in FIG. 7, a sliding sleeve 370 is seen in a shifted position with dart 372 seated on valve seat 374. The sleeve 370 shifted in response to pressure build-up after the seating of the dart. In its initial position, the sleeve 370 covered and closed the radial ports 376, preventing flow between the interior passageway 314 and the bypass passageway 378. Upon actuation and shifting, the sleeve allows fluid flow through radial ports 376 and into the bypass passageway 378, and into the annular passageway 350 below the drop-ball in sleeve 342. The fluid is communicated to the expansion assembly located below.

FIG. 8 is an elevational cross-sectional view of an exemplary caged-ball housing and valve assembly according to an aspect of the disclosure. A caged ball 380 is positioned in a cage housing 382 and temporarily held by extrusion sleeve 384. Cage ports 386 provide for fluid and pressure communication from the cage cavity 388 and the annular space 390. Cage sleeve 392, in an initial position, covers and closes the cage ports, protecting the caged ball from tubing pressure. In a second or shifted position (shown), the cage sleeve 392 moves to align sleeve ports 394 with cage ports 386, allowing fluid and pressure communication from the annulus to the cavity 388. Preferably, sleeve 392 is operated by tubing pressure. Tubing pressure forces the cage ball to extrude through the extrusion sleeve 384. The cage ball drops along the interior passageway 314 in tube 396 to a valve seat defined below, where it causes tubing pressure to actuate the radial expansion assembly.

A check valve sleeve 400 defines and operates an annular port below and is positioned between the expansion assembly sleeve 402 and tube 396, allowing flow from the annulus 408 between tube 396 and expansion sleeve 404 and into the annulus 410 between the cage ball housing 382 and the tubing housing. The annular port below, in the closed position, seals against this flow. Tube 396 has ports 406 allowing fluid flow from the interior passageway 314 in the tube and the annulus 410 when the ports 406 are open, that is not covered by the cage sleeve 392.

The tools, assemblies and methods disclosed herein can be used in conjunction with actuating, expansion, or other assemblies. For further disclosure regarding installation of a liner string in a wellbore casing, see U.S. Patent Application Publication No. 2011/0132622, to Moeller, which is incorporated herein by reference for all purposes.

For further disclosure regarding reverse circulation cementing procedures and tools, see U.S. Pat. No. 7,252,147, to Badalamenti, issued Aug. 7, 2007; U.S. Pat. No. 7,303,008, to Badalamenti, issued Dec. 4, 2007; U.S. Pat. No. 7,654,324, to Chase, issued Feb. 2, 2010; U.S. Pat. No. 7,857,052, to Giroux, issued Dec. 28, 2010; U.S. Pat. No. 7,290,612, to Rogers, issued Nov. 6, 2007; and U.S. Pat. No. 6,920,929, to Bour, issued Jul. 26, 2005; each of which is incorporated herein by reference in its entirety for all purposes.

For disclosure regarding expansion cone assemblies and their function, see U.S. Pat. No. 7,779,910, to Watson, which is incorporated herein by reference for all purposes. For further disclosure regarding hydraulic set liner hangers, see U.S. Pat. No. 6,318,472, to Rogers, which is incorporated herein by reference for all purposes. Also see, PCT Application No. PCT/US12/58242, to Stautzenberger, and U.S. Pat. No. 6,702,030; PCT/US2013/051542, to Hazelip, Filed Jul. 22, 2013; U.S. Pat. No. 6,561,271, to Baugh, issued May 13, 2003; U.S. Pat. No. 6,098,717, to Bailey, issued Aug. 8, 2000; and PCT/US13/21079, to Hazelip, Filed Jan. 10, 2013; each of which are incorporated herein by reference in their entirety for all purposes.

Further disclosure and alternative embodiments of release assemblies for running or setting tools are known in the art. For example, see U.S. Patent Publication 2012/0285703, to Abraham, published Nov. 15, 2012; PCT/US12/62097, to Stautzenberger, filed Oct. 26, 2012; each of which is incorporated herein in their entirety for all purposes, and references mentioned therein.

Running or setting tools, including setting assemblies, release assemblies, etc., are commercially available from Halliburton Energy Services, Inc., Schlumberger Limited, and Baker-Hughes Inc., for example.

Further disclosure relating to downhole force generators for use in setting downhole tools, see the following, which are each incorporated herein for all purposes: U.S. Pat. No. 7,051,810 to Clemens, filed Sep. 15, 2003; U.S. Pat. No. 7,367,397 to Clemens, filed Jan. 5, 2006; U.S. Pat. No. 7,467,661 to Gordon, filed Jun. 1, 2006; U.S. Pat. No. 7,000,705 to Baker, filed Sep. 3, 2003; U.S. Pat. No. 7,891,432 to Assal, filed Feb. 26, 2008; U.S. Patent Application Publication No. 2011/0168403 to Patel, filed Jan. 7, 2011; U.S. Patent Application Publication Nos. 2011/0073328 to Clemens, filed Sep. 23, 2010; 2011/0073329 to Clemens, filed Sep. 23, 2010; 2011/0073310 to Clemens, filed Sep. 23, 2010; and International Application No. PCT/US2012/51545, to Halliburton Energy Services, Inc., filed Aug. 20, 2012.

For disclosure regarding actuating mechanisms for use, for example, in rupturing a frangible barrier valve, see U.S. Patent Application Publication No. 2011/0174504, to Wright, filed Feb. 15, 2010; U.S. Patent Application Publication No. 2011/0174484, to Wright, filed Dec. 11, 2010; U.S. Pat. No. 8,235,103, to Wright, issued Aug. 7, 2012; and U.S. Pat. No. 8,322,426, to Wright, issued Dec. 4, 2012; all of which are incorporated herein by reference for all purposes.

In preferred embodiments, the following methods are disclosed; the steps are not exclusive and can be combined in various ways.

Exemplary methods of use of the invention are described, with the understanding that the invention is determined and limited only by the claims. Those of skill in the art will recognize additional steps, different order of steps, and that not all steps need be performed to practice the inventive methods described.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A method of cementing a liner in a wellbore extending through a subterranean zone using reverse circulation, the method comprising the steps of:

a. running a tubing string into the wellbore so that a wellbore annulus is defined therebetween, the tubing string defining an interior passageway along its length and having a reverse circulation assembly, a liner hanger, and a liner positioned below the liner hanger;

b. circulating fluid along a conventional circulation path during step a) by flowing fluid downhole through the interior passageway and uphole through the wellbore annulus;

c. sealing the wellbore annulus uphole from the liner by setting an annular isolation device in the wellbore annulus; and d. flowing cement along a reverse circulation path downhole from the annular isolation device by opening a reverse circulation port of the reverse circulation assembly to permit fluid flow from the interior passageway to the wellbore annulus at a position between the annular isolation device and the liner hanger.

2. The method of claim 1, further comprising a step of e) setting the cement in the wellbore annulus about the liner.

3. The method of claim 2, wherein step e) comprises setting the cement into a solid material using a setting process selected from the group consisting of: thermal, evaporative, drainage, chemical setting processes, and combinations thereof.

4. The method of claim 2, further comprising a step f) of setting the liner hanger.

5. The method of claim 4, wherein step f) is performed prior to the completion of step e).

6. The method of claim 4, wherein step f) comprises radially expanding an expandable liner hanger or at least one set of slips into engagement with a casing positioned in the wellbore.

7. The method of claim 4, wherein the step of setting the liner hanger further comprises dropping a drop-ball or caged-ball.

8. The method of claim 4, further comprising a step g) of establishing conventional flow after step f).

9. The method of claim 8, wherein step g) comprises flowing fluid through a liner hanger bypass valve, thereby allowing fluid flow from the liner hanger to the wellbore annulus uphole of the annular isolation device.

10. The method of claim 8, further comprising the step of disconnecting the liner from the tubing string uphole from the liner.

11. The method of claim 1, wherein the annular isolation device is set at a location in the wellbore having a casing, and wherein the annular isolation device is radially expanded to seal the wellbore annulus between the casing and the tubing string.

12. The method of claim 1, wherein the step of setting the annular isolation device further comprises the step of increasing tubing pressure to set the annular isolation device.

13. The method of claim 1, wherein the annular isolation device is set by mechanical expansion, explosive expansion, memory metal expansion, swellable material expansion, electromagnetic force-driven expansion, hydraulic expansion, or a combination thereof.

14. The method of claim 1, wherein step b) further comprises flowing fluid from the surface through the interior passageway, through a bottom outlet of the liner, and uphole along the wellbore annulus to the surface.

15. The method of claim 1, wherein step d) further comprises flowing fluid downhole through the interior passageway of the tubing string, through the reverse circulation port of the reverse circulation assembly, into the wellbore annulus at the position between the annular isolation device and the liner hanger, downhole through the wellbore annulus, and uphole through the interior passageway.

16. The method of claim 1, wherein step d) further comprises opening a reverse circulation return port of the reverse circulation assembly to permit fluid flow from the interior passageway to the wellbore annulus at a position uphole from the annular isolation device.

17. The method of claim 16, wherein step d) further comprises flowing the fluid through the reverse circulation return port, through a bypass passageway of the tubing string, and into the wellbore annulus at the position uphole from the annular isolation device to bypass the annular isolation device.

18. The method of claim 17, wherein step d) further comprises flowing the fluid uphole through the wellbore annulus.

19. The method of claim 17, wherein the bypass passageway of the tubing string extends along at least a length of the annular isolation device.

20. The method of claim 16, wherein the step of opening the reverse circulation return port comprises one or both of: moving a reverse circulation sliding sleeve to an open position and dropping a drop-ball or caged ball to operate the reverse circulation sliding sleeve.

21. The method of claim 1, wherein the step of opening the reverse circulation port comprises one or both of: moving a reverse circulation sliding sleeve to an open position and dropping a drop-ball or caged ball to operate the reverse circulation sliding sleeve.

22. A method of cementing a liner in a wellbore extending through a subterranean zone using reverse circulation, the method comprising the steps of:

a. running a tubing string into the wellbore, defining a wellbore annulus therebetween, the tubing string having a reverse circulation assembly, a liner hanger, a liner positioned below the liner hanger, and defining an interior passageway along its length;

b. circulating fluid along a conventional circulation path during step a) by flowing fluid downhole through the interior passageway and uphole through the wellbore annulus;

c. sealing the wellbore annulus uphole from the liner;

d. flowing cement along a reverse circulation path downhole from an annular isolation device, downhole along the length of the liner, and uphole through the interior passageway along the liner; and e. running a cement plug downhole through the interior passageway at the end of step d).

23. The method of claim 22, wherein the cement plug actuates a valve assembly allowing fluid flow from the interior passageway above the cement plug to the liner hanger.

24. The method of claim 23, wherein the step of actuating a valve assembly further comprises sliding a sleeve in response to increasing tubing pressure.

* * * * *